United States Patent [19]

Brunvoll

[11] 3,968,496

[45] July 6, 1976

[54] STABILIZED ANTENNA PLATFORM

[75] Inventor: Geir Brunvoll, Slattum, Norway

[73] Assignee: International Standard Electric Corporation, New York, N.Y.

[22] Filed: Mar. 4, 1975

[21] Appl. No.: 555,226

[30] Foreign Application Priority Data

Mar. 4, 1974 Norway ..... 731/74

[52] U.S. Cl. ..... 343/765; 248/182

[51] Int. Cl.[2] ..... H01Q 1/18

[58] Field of Search ..... 343/765, 766, 882; 248/182

[56] References Cited

UNITED STATES PATENTS

| | | | |
|---|---|---|---|
| 1,569,325 | 1/1926 | Leib | 343/764 |
| 3,860,931 | 1/1975 | Pope et al. | 343/765 |
| 3,893,123 | 7/1975 | Bieser | 343/765 |

*Primary Examiner*—Eli Lieberman

*Attorney, Agent, or Firm*—John T. O'Halloran; Peter Van Der Sluys; Vincent Ingrassia

[57] ABSTRACT

This relates to stabilized platforms for directive ship mounted antennas for satellite communication. The invention further relates to platforms comprising an antenna dish with elevation and azimuth control means, as well as counterweight means, being supported in a universal joint bearing. The main feature of the invention is that the platform includes a small mass system which is mechanically coupled to the platform in a damped manner, thereby stabilizing or damping the movements of the antenna caused by movements (roll/pitch) of the ship.

7 Claims, 5 Drawing Figures

STABILIZED ANTENNA PLATFORM

BACKGROUND OF THE INVENTION

The present invention relates to stabilized antenna platforms for ships and other floatable vessels and in particular to stabilized platforms for directive ship mounted antennas for satellite communication to compensate for roll and pitch movements of the ship. The invention further relates to platforms comprising an antenna dish with elevation and azimuth control means, as well as counterweight means, supported in a universal joint bearing.

Typically a ship may be subject to pitch and roll movements in the order of ± 6° – 10° and ± 20° – 30° respectively, dependent on ship type and loading conditions. It has been recommended by experts that a satellite communication ship terminal should have a G/T = −10dB. G/T denotes the ratio between antenna gain and the noise temperature of the receiving system. This corresponds to a net antenna gain of approximately 18 dB.

An antenna with a net gain (at the −3 dB points) of 18 dB will have a beamwidth of about 15°. It is thus obvious that even though the antenna must be pointed in the direction of the satellite, the accuracy of the pointing mechanism needs not be very high.

Antenna platforms are usually stabilized by means of gyro mechanisms, but such stabilizing systems are rather expensive and give higher accuracy than is now considered necessary.

In a paper by Mr. R. J. Kirkby, "A single stabilized antenna platform for maritime satellite communications" in Conference Publication No. 95 "Satellite Systems for Mobile Communications and Surveillance" published in 1973 by The Institution of Electrical Engineers, England, there is described a simple pendulum stabilized antenna platform.

The platform suggested by Mr. Kirkby is constructed as part of a pendulum with low natural frequency. The platform will then be relatively insensitive to ship movements at frequencies significantly higher than its natural frequency. Thus by keeping this natural frequency sufficiently low, the influence of the most severe ship movements can be reduced. It is stated that pointing accuracies better than ± 5° can theoretically be achieved in beam-sea conditions corresponding to Beaufort 9 winds. The accuracy is dependent on ship type.

One factor which limits the accuracy that can be obtained with this known platform is that the necessary damping of its movements is dependent on friction in the platform gimbal bearings. The amount of friction to be used must then be a compromise between the desired degree of damping and the amount of coupling that can be tolerated.

SUMMARY OF THE INVENTION

It is an object of the present invention to provide a stabilized antenna platform in which the damping action is made independent of the friction in the platform bearings.

According to a broad aspect of the invention, there is provided a stabilized antenna platform wherein there is provided an antenna dish having elevation and azimuth control means, as well as counterweight means, said antenna platform mounted upon an antenna mounting shaft, said antenna mounting shaft supported by a universal joint bearing, comprising: a small mass system mechanically coupled to said platform for damping the movements of said antenna platform.

The stabilized antenna platform according to the invention is very simple, and under the conditions mentioned, the motion of the antenna is theoretically reduced to ± 3° – 5° or better. This degree of stabilization will allow the use of antennas with a gain of approximately up to 24 dB.

The static/dynamic errors of such a platform are smaller than in any known simple antenna platform. The small mass system should be designed such that the natural frequency of the platform is lower than that of the ship, i.e. lower than one period per 7–20 seconds.

The damped movement of this mass system in respect to the platform will absorb energy, resulting in a damped movement of the platform itself. In this way, the damping of the platform and the friction in the bearings can be optimized independently.

The platform itself may be a pendulum or a completely balanced structure. In the last case, the attached masses must add the necessary stability to the platform.

The above and other objects of the present invention will be better understood from the following detailed description taken in conjunction with the accompanying drawings, in which:

DESCRIPTION OF THE PREFERRED EMBODIMENT

In the embodiments described below the elevation and azimuth controls are not considered, as these parts are not essential for the understanding of the present invention. It should be mentioned, however, that the purpose of such controls are to keep the antenna directed with certain limits, on a desired communication satellite.

Figure 1:
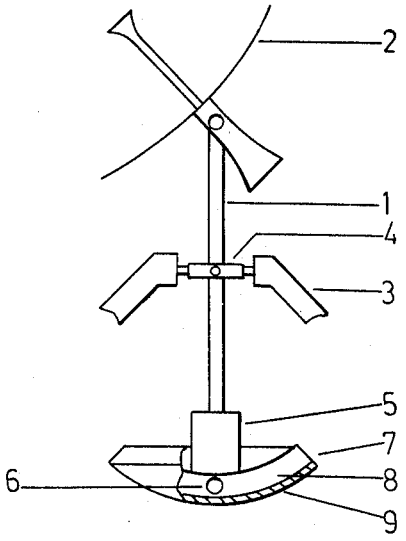
FIGS. 1, 2 and 3 show three different embodiments of the present invention.

FIG. 1 shows how such a platform can be realized. An antenna mounting shaft 1 and an antenna 2 can move freely with respect to a platform mount 3 by a universal joint 4. The antenna mounting shaft 1 and the antenna 2 are balanced by a counterweight 5.

Figure 2:
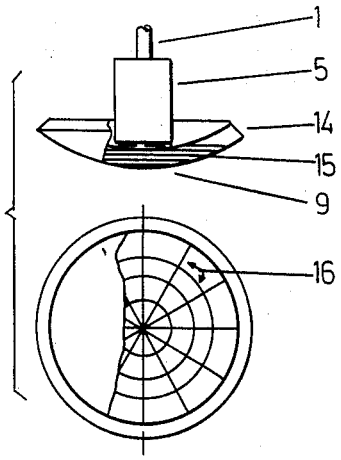
Figure 3:
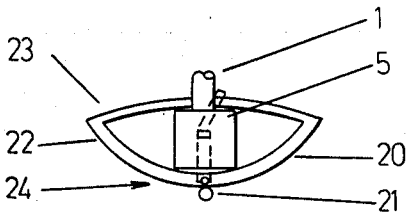

FIGS. 1, 2 and 3 show three different ways of arranging the platform damping means. In FIG. 1, ball 6 can move in a double-walled dish-shaped container 7 filled or partly filled with a liquid 8 with high viscosity. The ball (balls) should have higher density than the liquid. The container 7 is symmetrical around the axis of the antenna mounting shaft 1. The bottom wall 9 is shaped approximately as part of a sphere. A slight deviation from the spherical shape may be advantageous in order to make the degree of stabilization of the platform somewhat dependent on the amplitude of the motion of the ball 6.

Figure 4:
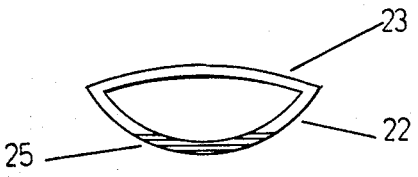
FIG. 4 shows the arrangement of FIG. 3 in more detail.

In FIG. 2, a container 14 is only partly filled with a liquid 15 and the ball 6 in FIG. 1 is omitted. The interior of the container 14 must then be provided with a system of restrictions (for example perforated walls or partitions 16 or a porous medium) so that the movement of the liquid can be effectively damped.

in FIG. 3, the hollow containers 7 and 14 are substituted, by two curved tubes 20, 21 mounted at right angles to each other. In FIG. 4 one of these tubes is shown in more detail. The lower part of the tube 22 is curved approximately as part of a circle, the center of which is on the axis of the mounting shaft 1. The upper part of the tube 23 provides a "return path" between the two ends of the tube. Restrictions in this tube 23 will determine the damping characteristics of the system. The tubes 22 may either contain balls 24 and be filled (or partly filled) with viscous liquid like the container 7 in FIG. 1, or they may be only partly filled with liquid 25 like the container 14 in FIG. 2. In the latter case the tubes 22 may alternatively also be provided with restrictions to damp the movements of the liquid 25. The return path may alternatively be deleted, depending on to which extent the tubes are filled and depending on the diameter of the ball relative to the diameter of the tube.

In FIGS. 1–3 the damping means are shown mounted underneath the counterweight 5. This is a practical solution, but not a requirement.

Figure 5:
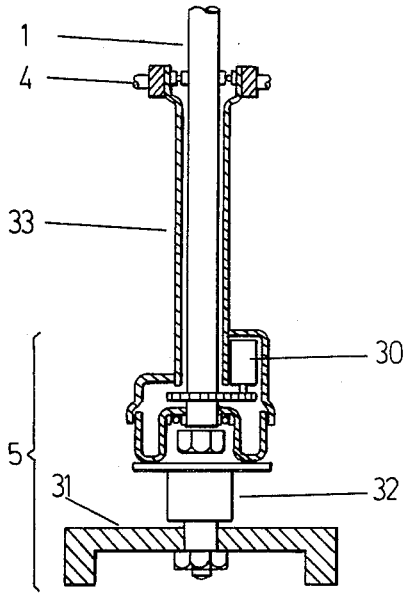
FIG. 5 shows an arrangement for increasing the moment of inertia of the platform.

The counterweight 5 may include a servo motor 30 for azimuth pointing of the antenna, as shown in FIG. 5. It may also contain a momentum wheel 31 with drive motor 32. The spin axis of the momentum wheel 31 should be the same as the axis of the mounting shaft 1. This arrangement will improve the stabilization of the platform. The counterweight 5 including the mentioned parts is fixed to the universal joint 4 by means of a tube-like arrangement 33, while the shaft 1 is free to rotate within this tube. The momentum wheel and the small mass system (not shown in this drawing) may be placed anywhere on the mounting shaft 1, above or below the universal joint bearing 4. When the parts are mounted above the joint 4, they do not constitute a part of the counterweight 5.

It should be noted that the embodiments described above are examples only. The arrangement of liquid containers and tubes may be varied in many ways, i.e. the curvatures and other dimensions, relative amounts of liquid, relative dimensions of counterweights and the damping mass system may be changed to optimally fit a particular antenna for a particular ship. Due to environmental temperature variations, it may in some cases be desirable to control the viscosity of the liquid by means of temperature compensation.

There may also be used one or more tube sets consisting of curved tubes crossing each other or laying parallel to each other. These tubes may have different curvatures, and the moving masses may also have different designs and weights. The small mass system may alternatively have a design quite different from the embodiments shown in the drawings. Thus the mechanically coupled mass(es) may consist of intercoupled pendulums or the small mass system may be resiliently connected to the platform.

While the principles of the invention have been described above in connection with specific apparatus, it is to be clearly understood that this description is made only by way of example and not as a limitation on the scope of the invention.

What is claimed is:

1. A stabilized antenna platform wherein there is provided an antenna dish having elevation and azimuth control means, as well as counterweight means, said antenna platform mounted upon an antenna mounting shaft, said antenna mounting shaft supported by a universal joint bearing, comprising:

at least one closed container symmetrically arranged around said mounting shaft containing a liquid and provided with internal liquid flow damping means, said closed container forming a small mass system mechanically coupled to said platform for damping the movements of said antenna platform.

2. A stabilized antenna platform according to claim 1 wherein said container also contains at least one freely movable ball having a higher density than said liquid.

3. A stabilized antenna platform according to claim 1 wherein said small mass system comprises a double-walled dish-shaped container.

4. A stabilized antenna platform according to claim 1 wherein said container comprises a plurality of curved tubes.

5. A stabilized antenna platform according to claim 4 wherein each of said curved tubes is provided at their ends with an interconnecting return path tube with predetermined restrictions to control the movement of the liquid in said tubes.

6. A stabilized antenna platform according to claim 1 further including a motor-driven momentum wheel in said counterweight means.

7. A stabilized antenna platform according to claim 1 wherein the viscosity of said liquid is controlled by means of temperature compensation.

* * * * *